United States Patent [19]

Inai et al.

[11] Patent Number: 4,965,102

[45] Date of Patent: Oct. 23, 1990

[54] METHOD FOR COATING A METAL SUBSTRATE BY THE USE OF A RESIN COMPOSITION

[75] Inventors: Toshimi Inai, Takatsuki; Koji Motoi, Kyoto, both of Japan

[73] Assignee: Sekisui Kagaku Kogyo Kabushiki Kaisha, Osaka, Japan

[21] Appl. No.: 314,997

[22] Filed: Feb. 24, 1989

[51] Int. Cl.[5] ..... B05D 3/02

[52] U.S. Cl. ..... 427/374.4; 427/388.1; 427/407.1; 427/409

[58] Field of Search ..... 427/374.4, 388.1, 407.1, 427/409

[56] References Cited

U.S. PATENT DOCUMENTS

| | | | |
|---|---|---|---|
| 4,255,462 | 3/1981 | Gibauer et al. | 427/195 X |
| 4,314,004 | 2/1982 | Stoneburg | 427/409 X |
| 4,379,885 | 4/1983 | Miller et al. | 525/108 |
| 4,557,977 | 12/1985 | Memmer et al. | 427/409 X |
| 4,654,235 | 3/1987 | Effonberger et al. | 427/407.3 |

FOREIGN PATENT DOCUMENTS

| | | |
|---|---|---|
| 2143955 | 2/1973 | France . |
| 46-2918 | 1/1971 | Japan . |
| 47-15233 | 5/1972 | Japan . |
| 1364338 | 8/1974 | United Kingdom . |
| 2138429 | 10/1984 | United Kingdom . |

*Primary Examiner*—Michael Lusignan

*Attorney, Agent, or Firm*—Irell & Manella

[57] ABSTRACT

There is provided a method for coating a metal substrate by the use of a polyvinylidene fluoride resin composition. The method comprises forming a coating film made of a melted resin composition on the surface of an undercoated metal substrate at a temperature of from 200° to 350° C., said resin composition containing a major amount of polyvinylidene fluoride and from 5 to 40% by weight of an inorganic filler based on the total weight of the resin composition; and precooling said coating film to a temperature $T_A$ and then keeping said coating film at the temperature $T_A$ for at least one minute, wherein said temperature $T_A$ (°C.) satisfies the inequality:

$$T_C - 10°C. \leqq T_A \leqq T_C + 10°C.,$$

said $T_C$ (°C.) being the crystallization temperature for the polyvinylidene fluoride.

10 Claims, No Drawings

METHOD FOR COATING A METAL SUBSTRATE BY THE USE OF A RESIN COMPOSITION

BACKGROUND OF THE INVENTION

1. Field of the invention:

This invention relates to a method for coating a metal substrate by the use of a resin composition comprising a major amount of polyvinylidene fluoride. More particularly, it relates to a method for preparing a coated metal substrate with polyvinylidene fluoride with excellent hot-water resistance and chemical resistance at high temperatures.

2. Description of the prior art:

Polyvinylidene fluoride (PVdF) has excellent mechanical properties, heat resistance, and weather resistance. Also, it has excellent water resistance and chemical resistance. Therefore, this kind of resin is used as a coating material for films that are used for packaging chemicals, as a coating material for containers in which corrosive chemicals are stored, or as a coating material for protecting metal parts used in various factories in the chemical and food industries. As mentioned above, PVdF has many excellent characteristics. However, because PVdF has a high degree of crystallinity, residual stress arising from the crystallization of PVdF will easily form in the coating layer containing the PVdF. Moreover, like other fluororesins, PVdF has poor adhesion to metals and to other resins. Therefore, when a substrate coated with PVdF is immersed in hot water or exposed to chemicals at high temperatures for a long time, the coating layer can crack or peel because of the residual stress, and can blister and peel because of the permeation of hot water or chemicals such as acids into the coating layer.

There have been proposed various methods of reducing the residual stress arising from crystallization of PVdF after its coating. For example, Japanese Patent Publication No. 46-2918 discloses a method for heat treatment of a coating layer made of PVdF formed on a metal substrate by conventional techniques such as electrostatic coating and baking. In this method, the coated substrate with PVdF is reheated at a given temperature to melt a small part or most of the PVdF crystal, and then cooled gradually. The given temperature mentioned above may be the temperature at which the PVdF begins to melt (i.e., a slightly lower temperature than its melting point) to the temperature higher than the melting point by 10° C., and preferably from the melting point to the temperature that is higher than the melting point by 10° C. Japanese Patent Publication No. 47-15233 discloses a method comprising the formation of a PVdF coating layer on a metal substrate by the powder coating technique and the like, heating and melting the PVdF coating layer, and then precooling the coating layer within a given temperature range followed by rapid quenching to a given temperature (80° C.). The temperature for precooling may be in the range of from the temperature that is higher than the crystallization temperature of PVdF by 10° C. to its melting point.

According to the methods disclosed in the above-mentioned publications, the residual stress of PVdF will be reduced, resulting in less cracking and peeling of the PVdF coating layer. However, the PVdF coating layer consists generally of a crystallized part with relatively high density in which the orientation of PVdF molecules is regular, and a rubber part with relatively low density in which the orientation is irregular. Thus, hot water or chemicals such as acids permeate from the rubber part into the PVdF coating layer, and the coating layer of PVdF blisters or peels.

SUMMARY OF THE INVENTION

The method for coating metal substrates by the use of a polyvinylidene fluoride resin composition of the present invention, which overcomes the above-discussed and numerous disadvantages and deficiencies of the prior art, comprises forming a coating film made of a melted resin composition on the surface of an undercoated metal substrate at a temperature of from 200° to 350° C., said resin composition on the surface of an major amount of polyvinylidene fluoride and from 5 to 40% by weight of an inorganic filler based on the total weight of the resin composition; and precooling said coating film to a temperature $T_A$ and then keeping said coating film at the temperature $T_A$ for at least one minute, wherein said temperature $T_A$ (°C.) satisfies the inequality:

$$T_C - 10°\ C. \leqq T_A \leqq T_C + 10°\ C.,$$

said $T_C$ (°C.) being the crystallization temperature for the polyvinylidene fluoride.

In a preferred embodiment, the inorganic filler is at least one selected from the group consisting of metal oxide, glass, carbon, and ceramics.

In a preferred embodiment, the undercoated metal substrate is prepared by applying an undercoat composition containing a major amount of thermosetting resin to the metal substrate.

In a preferred embodiment, the undercoat composition contains at least one inorganic filler selected from the group consisting of metals, metal oxides, glass, carbon, ceramics, and crystals of inorganic compounds.

In a preferred embodiment, the undercoated metal substrate is prepared by applying an undercoat composition containing a thermosetting resin and polyvinylidene fluoride to the metal substrate.

Thus, the invention described herein makes possible the objectives of (1) providing a method for forming a coating layer made of PVdF with excellent hot-water resistance and chemical resistance at elevated temperatures on a metal substrate; (2) providing a method for forming a coating layer made of PVdF on a metal substrate, which coating layer has excellent hot-water resistance and excellent chemical resistance, so that there is no peeling and cracking of the coating layer., (3) providing a method for coating a metal substrate, which can be used for various applications such as containers for chemicals, pipes, reactors, etc., of industrial plants.

DESCRIPTION OF THE PREFERRED EMBODIMENT

Polyvinylidene fluoride (PVdF) in the resin composition used in the method of the present invention can be prepared by conventional polymerization techniques such as emulsion polymerization, suspension polymerization and the like. The melt flow rate of the PVdF, as measured by the flow rate test (ASTM D1238; at the temperature of 235° C. under the load of 5000 g), is preferably from 2 to 30 g/10 minutes. A melt flow rate of less than 2 g/10 minutes makes it difficult to form a PVdF film on a metal substrate continually. Thus, some solvents, plasticizers, and the like must be used to form the PVdF film. When the melt flow rate is more than 30 g/10 minutes, the PVdF film obtained has poor impact resistance, resulting in the generation of cracking in the film. Preferably, the resin composition contains the polyvinylidene fluoride in the form of a fine powder in order to form the PVdF film uniformly. The mean particle size of the polyvinylidene fluoride is adjusted to from 1 to 200 μm, and preferably from 10 to 80 μm.

The resin composition containing a major amount of the PVdF mentioned above includes an inorganic filler. The inorganic filler increases the thermal conductivity and the elastic modules of the coating layer formed by the resin composition containing the PVdF. Moreover, the inorganic filler reduces the internal residual stress of the coating layer.

The inorganic fillers that can be used include those with excellent water resistance and chemical resistance that are stable even at the temperature of 300° C. Examples of the inorganic fillers include metal oxide, glass, carbon, ceramics, and the like. The metal oxide includes, for example, alumina, iron oxide, titanium oxide, zirconium oxide, chromium oxide, nickel oxide, and the like. Also included is potassium titanate. The ceramics include, in addition to those listed as the metal oxides mentioned above, silicon nitride, titanium nitride, boron carbide, silicon carbide, and the like. The inorganic filler is preferably present as a fine powder in the form of fibers, granules, or flakes. The inorganic filler is preferably present in the resin composition of the invention in the amount of from 5 to 40% by weight, and preferably from 10 to 30% by weight. When less than 5% by weight of the inorganic filler is present in the resin composition, satisfactory prevention of cracking and blistering in the coating layer cannot be obtained. When more than 40% by weight of the inorganic filler is present in the resin composition, the adhesiveness of the polyvinylidene fluoride to a metal substrate decreases, resulting in poor adhesion of the resin coating layer to the metal substrate.

An undercoat composition used in the present invention includes a thermosetting resin, which is preferably a mixture of a thermosetting resin and polyvinylidene fluoride. When the mixture mentioned above is used as an undercoat composition, a network structure will be formed by applying the undercoat composition to a metal substrate followed by baking the undercoated substrate obtained, so that adhesiveness between the PVdF resin layer mentioned below and the metal substrate is improved. Also, excellent adhesion of the undercoat layer to the metal substrate can be obtained by the curing of thermosetting resin. The thermosetting resin includes, for example, imide resins, epoxy resins, phenol resins, amide-imide resins, furan resins, and the like. The thermosetting resin is used in an amount of from 10 to 900 parts by weight, and preferably from 25 to 400 parts by weight for 100 parts by weight of polyvinylidene fluoride.

Optionally, the undercoat composition may contain an inorganic filler. The inorganic filler prevents the undercoat layer formed by the undercoat composition from peeling and cracking. The inorganic filler that can be added to the undercoat layer includes, for example, metals, metal oxides, glass, carbon, ceramics, inorganic crystals, and the like. The metal includes, for example, aluminium, zinc, nickel alloys, stainless steel, cast iron, and the like. As the metal oxide, glass, and ceramics, the materials used in the polyvinylidene fluoride coating layer mentioned above can be used. The metal, metal oxide, glass, carbon, and ceramics are preferably used in the form of fine particles. The mean particle size of the fine particle is adjusted to from 1 to 100 μm, and preferably from 5 to 30 μm. Also, the inorganic filler is preferably used in an amount of from 10 to 800 parts by weight of the thermosetting resin, and preferably from 25 to 400 parts by weight for 100 parts by weight. When less than 10 parts by weight of the inorganic filler is added to the undercoat composition, the inorganic filler does not give the desired results in the composition. When more than 800 parts by weight of the inorganic filler is added to the undercoat composition, the adhesiveness of the thermosetting resin and polyvinylidene fluoride to the metal substrate decreases, resulting in poor adhesion of the undercoat layer to the metal substrate.

When a PVdF resin composition is coated on the metal substrate by the method of the present invention, the metal substrate to be coated is first treated appropriately by sandblasting, degreasing, chemical treatment with phosphate solution, or the like.

Next, the undercoat composition mentioned above is applied on the surface of the pretreated metal substrate, heated, and baked to form an undercoat layer. The baking temperature is preferably in the range of from 150° to 250° C. The thickness of the undercoat layer is preferably in the range of from 5 to 100 μm, and more preferably from 10 to 30 μm. When the thickness of the undercoat layer is less than 5 μm, the undercoat layer cannot be formed uniformly, so that pinholes and cracks will readily occur. When the thickness of the undercoat layer is more than 100 μm, the adhesiveness of the undercoat layer to the metal substrate becomes poor.

A coating layer made of the resin composition is formed on the surface of the metal substrate that has been undercoated as described above. The resin composition contains the PVdF and the inorganic filler mentioned above. For example, the coating layer is formed as follows. The resin composition mentioned above is dissolved in an appropriate organic solvent to obtain an emulsion. The emulsion is applied to the surface of the undercoated metal substrate. The resin composition is also applicable in the form of a powder instead of the emulsion. Preferably, the coating layer is formed by the powder-coating of the resin composition containing polyvinylidene fluoride as a fine powder. Next, the coating is baked (heated) at the temperature of from 200° to 350° C. to form a melted film on the surface of the metal substrate. When the baking temperature is less than 200° C., the polyvinylidene fluoride is not baked completely, so that pinholes, etc., will readily occur. When the baking temperature is greater than 350° C., the polyvinylidene fluoride is thermally decomposed with the release of hydrogen fluoride. The thickness of the coating layer formed in such a way is in the range of from 50 to 2000 μm , and preferably from 250 to 1000 μm. When the thickness of the coating layer is less than 50 μm, the coating layer cannot be formed uniformly, so that pinholes and cracking will readily occur. When the thickness of the coating layer is more than 2000 μm, a fine coating layer cannot be formed because of foaming. Also, it takes a long time to bake such a thick layer.

Then, the coated metal substrate provided with the coating layer made of the PVdF resin composition is preliminarily cooled at a given temperature to crystallize the resin of the coating layer before it is finally cooled to room temperature. The precooling temperature is in the range of from the temperature lower than the crystallization temperature of PVdF by 10° C. to the temperature higher than the crystallization temperature by 10° C. As used herein, the crystallization temperature of polyvinylidene fluoride refers to a temperature at the peak (which corresponds to an exothermic change) of the crystallization curve therefor obtained in differential thermal analysis while the temperature decreases at the rate of 3° C./min. The crystallization temperature of polyvinylidene fluoride can be varied widely, depending upon the polymerization technique and degree of polymerization. For example, the crystallization temperature of the typical polyvinylidene fluorides used in the examples of the present invention is 140° C. When the precooling temperature is lower than the lower limit of temperature mentioned above, polyvinylidene fluoride is solidified without regular orientation of its molecules, so that cracks and blisters will readily occur because of high residual stress. When the precooling temperature is higher than the upper limit of temperature mentioned above, the polyvinylidene fluoride does not crystallize. The precooling time is at least one minute, usually from 1 to 200 minutes, and preferably from 10 to 60 minutes. When the precooling time is less than one minute, the polyvinylidene fluoride is crystallized rapidly, so that the residual stress caused by the crystallization will be high.

According to the method of the present invention described above, the resin coating layer is precooled at an appropriate temperature. Thus, crystallization of the PVdF contained in the coating layer can proceed with the molecules thereof taking on a uniform orientation. Therefore, the resulting coating layer has relatively low residual stress and high crystallinity, preventing the cracking and peeling caused by the permeation of hot water and chemicals into the coating layer. Moreover, because the coating layer contains an inorganic filler, its thermal conductivity will increase. In general, the greater the difference in temperature between the surface portion of the coating layer and the portion thereof in contact with a metal substrate, the more easily hot water and chemicals such as acids can permeate the coating layer. Therefore, when a coating layer with high thermal conductivity is formed on the metal substrate, the permeation and diffusion of hot water and chemicals will not readily occur because of the small temperature difference in the coating layer. Moreover, the inorganic filler enhances the elastic modules of the coating layer. Thus, even if hot water and chemicals permeate into the coating layer, the separation of the coating layer from the metal substrate, i.e. blisters, will not occur. According to the present invention, a metal substrate can be covered with a coating layer made of PVdF in which no cracks, peeling, or blisters caused by the permeation of hot water and chemicals will form.

EXAMPLE 1 (A) Formation of undercoat layer

First, 10 g of aminobismaleimide oligomer resin (KERIMID 601, Rhone Poulenc Corp.), and 1.0 g of polyvinylidene fluoride resin powder were dissolved in dimethylacetamide. This solution was mixed with 50 g of aluminium powder (mean particle diameter, 44μm or less) to obtain an undercoat composition. The polyvinylidene fluoride resin powder had a mean particle diameter of from 40 to 60μm a melt flow rate of 15 g/10 minutes (temperature, 235° C; under a load of 5000 g), and a crystallization temperature of 140° C.

An iron plate (100 mm ×100 mm ×3 mm) was treated by grit blasting and cleaned by the use of a compressed air. After the undercoat composition obtained was coated on one side of this plate with a brush, the plate was dried for 30 minutes at the temperature of 100° C., and then baked for 30 minutes at the temperature of 150° C. and for 30 minutes at the temperature of 250° C. The resulting undercoating layer was 20 μm thick, on the average.

(B) Formation of coating layer

Eighty grams of polyvinylidene fluoride resin powder used in the undercoat composition mentioned above and 20 g of powdered glass fibers (mean particle diameter, about 9 μm; length, about 60 to 80 μm) as an inorganic filler were mixed to obtain a powderous resin composition. The resin composition was applied to the undercoated iron plate obtained in section A by electrostatic coating, baked for 30 minutes at the temperature of 250° C, preliminarily cooled for 30 minutes at the temperature of 140° C., and then finally cooled to room temperature to form a coating layer. The resulting coating layer was 500 μm thick, on the average.

(C) Evaluation of PVdF coated metal substrate

The resulting coated iron plate obtained in section B was evaluated by the procedure below. The results are shown in Table 1. The results of Examples 2 and 3, and Comparative Example 1 to 4 are also shown in Table 1.

(1) Adhesion-strength test (peeling test)

A knife was used to make incisions in a checkerboard pattern in the coating layer with 1-mm spacing down to the metal substrate of the PVdF-coated metal substrate, after which the coating layer was observed.

(2) Hot water test

The coated metal plate was immersed into hot water for 1000 hours, so that the resin-coated side was kept at 100° C. and the metal substrate side was kept at 65° C. The resin-coated layer was evaluated by measuring the area of blisters in the coating layer, and then calculating the percentage of the blistered area in relation to the whole area.

EXAMPLE 2

A resin-coated metal substrate was obtained by the procedure of Example 1 except that 85 g of polyvinylidene fluoride resin powder and mica powder (mean particle diameter, about 50 to 100 μm) as an inorganic filler were used in the formation of the coating layer, and that the coating layer was preliminarily cooled for 45 minutes at the temperature of 145° C.

EXAMPLE 3

A resin-coated metal substrate was obtained by the procedure of Example 1 except that 85 g of polyvinylidene fluoride resin powder and 15 g of powdered carbon fibers (mean diameter, about 7 μm; length, about 40 to 60 μm) as an inorganic filler were used in the formation of the coating layer, and the coating layer was preliminarily cooled for 20 minutes at the temperature of 135° C.

COMPARATIVE EXAMPLE 1

A resin-coated metal substrate was obtained by the procedure of Example 1 except that the inorganic filler was not used in the resin composition.

COMPARATIVE EXAMPLE 2

A resin-coated metal substrate was obtained by the procedure of Example 1 except that the coating layer was cooled by immersing the coated metal substrate into water at room temperature instead of the preliminary cooling.

COMPARATIVE EXAMPLE 3

A resin-coated metal substrate was obtained by the procedure of Example 1 except that the coated substrate was preliminarily cooled for 30 minutes at the temperature of 160° C.

COMPARATIVE EXAMPLE 4

A resin-coated metal substrate was obtained by the procedure of Example 1 except that the coated substrate was preliminarily cooled for 30 minutes at the temperature of 120° C.

TABLE 1

| | Peeling test | Hot water test |
|---|---|---|
| Example 1 | no peeling | 0% |
| Example 2 | no peeling | 0% |
| Example 3 | no peeling | 0% |
| Comparative Example 1 | peeling observed in places | 50% |
| Comparative Example 2 | peeling observed in places | 50% |
| Comparative Example 3 | no peeling | 30% |
| Comparative Example 4 | no peeling | 30% |

As shown in Table 1, the adhesiveness between the coating layer and the metal substrate was excellent in the resin-coated metal substrate of this invention. Thus, the coating layer was not peeled readily from the metal substrate. Also, when the coated metal substrate came into contact with hot water, peeling and blistering did not occur. On the other hand, with the coated metal substrate in which the coating layer did not contain inorganic filler, and in the coated metal substrate prepared by different cooling conditions, the coating layer peeled readily. Also, when these coated metal substrates came into contact with hot water, peeling and blistering of the coating layer occurred easily.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A method for coating a metal substrate by the use of a resin composition comprising:

forming a coating film made of a melted resin composition on the surface of an undercoated metal substrate at a temperature of from 200° to 350° C., said resin composition containing a major amount of polyvinylidene fluoride and from 5 to 40% by weight of an inorganic filler based on the total weight of the resin composition; and precooling said coating film to a temperature $T_A$ and then keeping said coating film at the temperature $T_A$ for at least one minute, wherein said temperature $T_A$ (°C.) satisfies the inequality:

$$T_C - 10° C. \leqq T_A \leqq T_C + 10° C.,$$

said $T_C$ (°C.) being the crystallization temperature for the polyvinylidene fluoride.

2. A method according to claim 1, wherein said inorganic filler is at least one selected from the group consisting of metal oxides, glass, carbon, and ceramics.

3. A method according to claim 1 wherein said undercoated metal substrate is prepared by applying an undercoat composition containing a major amount of thermosetting resin to the metal substrate.

4. A method according to claim 3, wherein said undercoat composition contains at least one inorganic filler selected from the group consisting of metals, metal oxides, glass, carbon, ceramics, and crystals of inorganic compounds.

5. A method according to claim 1 wherein said undercoated metal substrate is prepared by applying an undercoat composition containing a thermosetting resin and polyvinylidene fluoride to the metal substrate.

6. A method according to claim 2 wherein said undercoated metal substrate is prepared by applying an undercoat composition containing a major amount of thermosetting resin to the metal substrate.

7. A method according to claim 2 wherein said undercoated metal substrate is prepared by applying an undercoat composition containing a thermosetting resin and polyvinylidene fluoride to the metal substrate.

8. A method according to claim 6 wherein said undercoat composition contains at least one inorganic filler selected from the group consisting of metals, metal oxides, glass, carbon, ceramics, and crystals of inorganic compounds.

9. A method according to claim 1, wherein during the precooling step, the coating film is kept at the temperature $T_A$ for a time in range of from at least one minute to no more than 200 minutes.

10. A method according to claim 9, wherein during the precooling step, the coating film is kept at the temperature $T_A$ for a time in the range of from 10 to 60 minutes.

* * * * *